US007681956B2

(12) United States Patent
Huang

(10) Patent No.: US 7,681,956 B2
(45) Date of Patent: Mar. 23, 2010

(54) EASY-ASSEMBLED CHAIR

(76) Inventor: Tsung Chieh Huang, 235 Chung-Ho Box 8-24, Taipei (TW)

( * ) Notice: Subject to any disclaimer, the term of this patent is extended or adjusted under 35 U.S.C. 154(b) by 545 days.

(21) Appl. No.: 11/232,142

(22) Filed: Sep. 22, 2005

(65) Prior Publication Data

US 2010/0019549 A1 Jan. 28, 2010

(51) Int. Cl.

| | |
|---|---|
| ***A47C 7/00*** | (2006.01) |
| ***A47C 1/12*** | (2006.01) |
| ***A47B 39/00*** | (2006.01) |
| ***A47C 7/02*** | (2006.01) |

(52) U.S. Cl. ..... 297/440.16; 297/448.2; 297/440.22; 297/170; 297/452.22

(58) Field of Classification Search ..... 297/448.2, 297/440.16, 440.15, 170, 448.1, 440.1, 440.22, 297/440.2, 452.22, 452.21, 171, 160, 449.1, 297/411.23, 411.24, 411.25, 411.26, 411.27, 297/411.28

See application file for complete search history.

(56) References Cited

U.S. PATENT DOCUMENTS

| | | | | |
|---|---|---|---|---|
| 2,900,013 | A * | 8/1959 | Hamilton | 297/271.6 |
| 3,393,941 | A * | 7/1968 | Grosfillex | 297/440.22 |
| 3,724,897 | A * | 4/1973 | Faiks et al. | 297/447.3 |
| 4,305,617 | A * | 12/1981 | Benoit | 297/448.2 |
| 4,611,852 | A * | 9/1986 | Filer | 297/352 |
| 5,026,121 | A * | 6/1991 | Ratalahti | 297/440.16 |
| 5,498,065 | A * | 3/1996 | Tosoni | 297/440.21 |
| 6,899,386 | B2 * | 5/2005 | Anton | 297/170 |
| 6,935,698 | B1 * | 8/2005 | Chen | 297/440.22 |

* cited by examiner

*Primary Examiner*—Milton Nelson, Jr.

(57) ABSTRACT

An easy-assembled chair comprises a frame body having a seat frame; a cushion; the backside of the cushion having at least one recess; at least one through hole being formed in the recess; a back pad; a lower edge of the back pad being formed with at least one protruding sheet; at least one hook being installed at the protruding sheet; a combining device for combined handles or a table plate to legs of the seat frame of the frame body. The hook of the protruding sheet passes through the through hole of the recess of the cushion to hook the back rod of the seat frame. The frame body has supporting rods; and a rear side of the seat frame has a back rod; the hooks of the back pad can hook the back rod so as to secure the back pad to the frame body.

12 Claims, 9 Drawing Sheets

EASY-ASSEMBLED CHAIR

FIELD OF THE INVENTION

The present invention relates to chairs, and particularly to an easy-assembled chair, wherein by the engagement of the at least one penetrating hole of the frame body and the at least one hook of the back pad, the frame body, cushion and back pad are combined firmly. Moreover, in the present invention, all the elements are assembled by insertion or buckling, and thus the assembly work is time-saved. Further, the present invention can be combined with a table plate or handles by combining devices.

BACKGROUND OF THE INVENTION

In the prior art chairs, the chair is formed mainly by a frame body, a cushion and a back pad. The assembly of these components are performed by studs and screws. However in this prior art structure, the components must be formed with threaded holes or protruded studs for combining these components, or some other screws are used to combine these components. Thereby the manufacturing process is complicated and the assembly work is tedious and time consumed. Thereby it is difficult as the components are to be reused because more works are necessary to detach these components, even it is very often the detaching of the studs and screws cannot be performed so that some components cannot be reused.

SUMMARY OF THE INVENTION

Accordingly, the primary object of the present invention is to provide an easy-assembled chair, wherein by the engagement of the at least one penetrating hole of the frame body and the at least one hook of the back pad, the frame body, cushion and back pad are combined firmly. Moreover, in the present invention, all the elements are assembled by insertion or buckling, and thus the assembly work is time-saved. Further, the present invention can be combined with a table plate or handles by combining devices.

To achieve above objects, the present invention provides an easy-assembled chair which comprises a frame body having a seat frame; a cushion; the backside of the cushion having at least one recess; at least one through hole being formed in the recess; a back pad; a lower edge of the back pad being formed with at least one protruding sheet; at least one hook being installed at the protruding sheet; a combining device for combined handles or a table plate to legs of the seat frame of the frame body. The hook of the protruding sheet pass through the through hole of the recess of the cushion to hook the back rod of the seat frame. The frame body has supporting rods; and a rear side of the seat frame has a back rod; the hooks of the back pad can hook the back rod so as to secure the back pad to the frame body.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
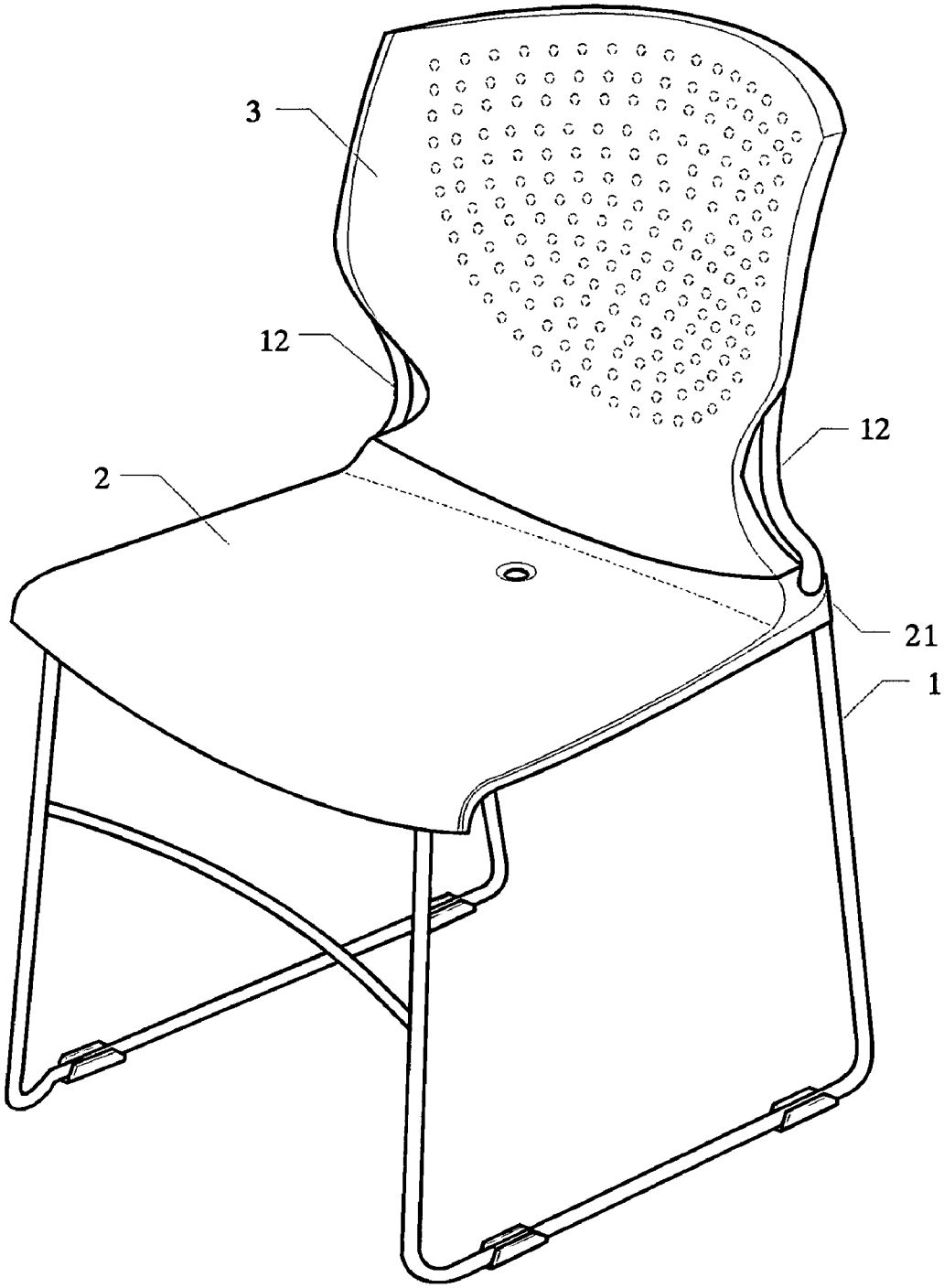
FIG. 1 shows the embodiment of the present invention.
Figure 2:
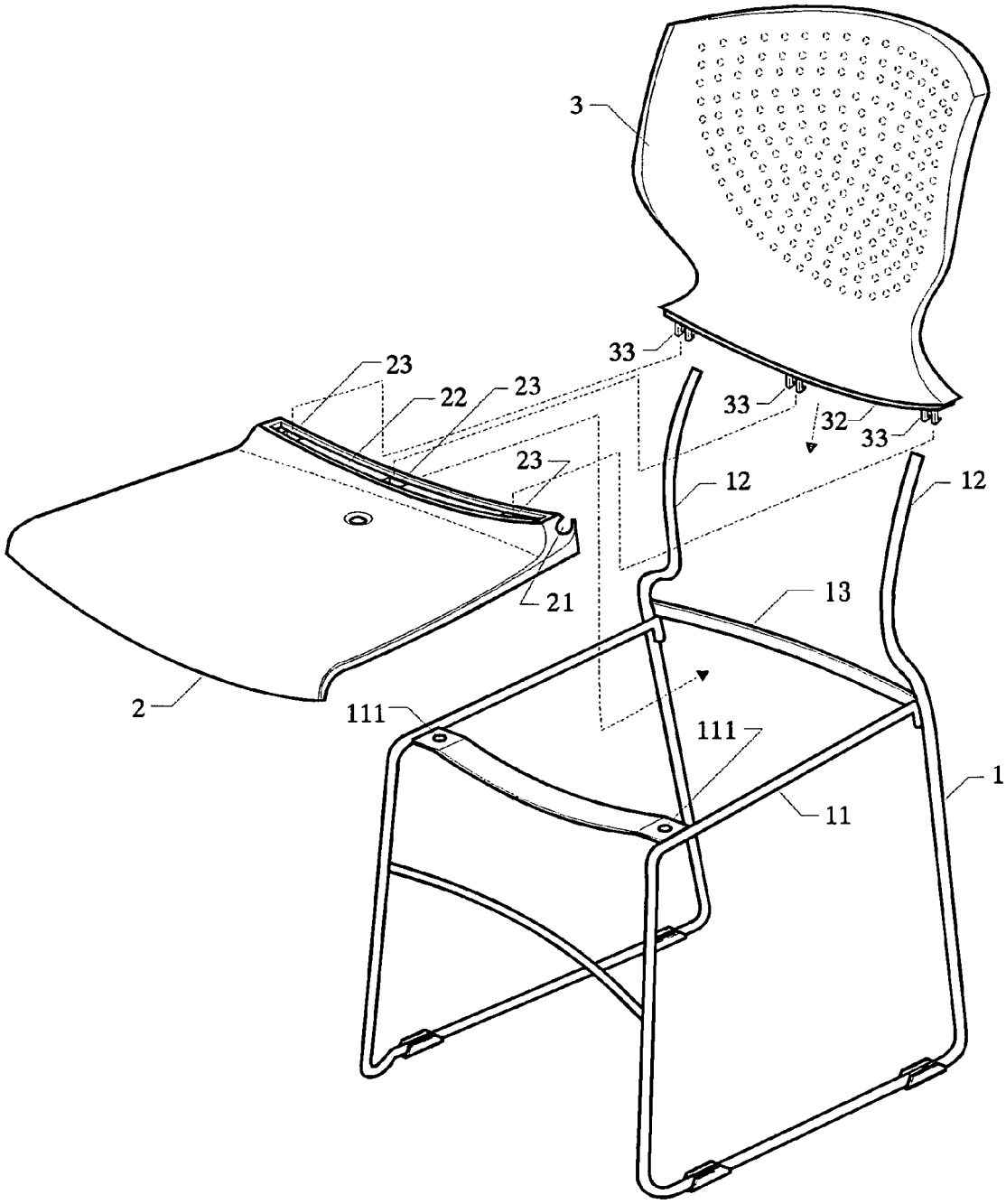
FIG. 2 shows the schematic view of the present invention.

With reference to FIGS. 1 and 2, the chair of the present invention has the following elements.

A frame body 1 has a seat frame 11 and two supporting rods 12. A front side of the seat frame 11 has two penetrating holes 111. A rear side of the seat frame 11 has a back rod 13.

Figure 3:
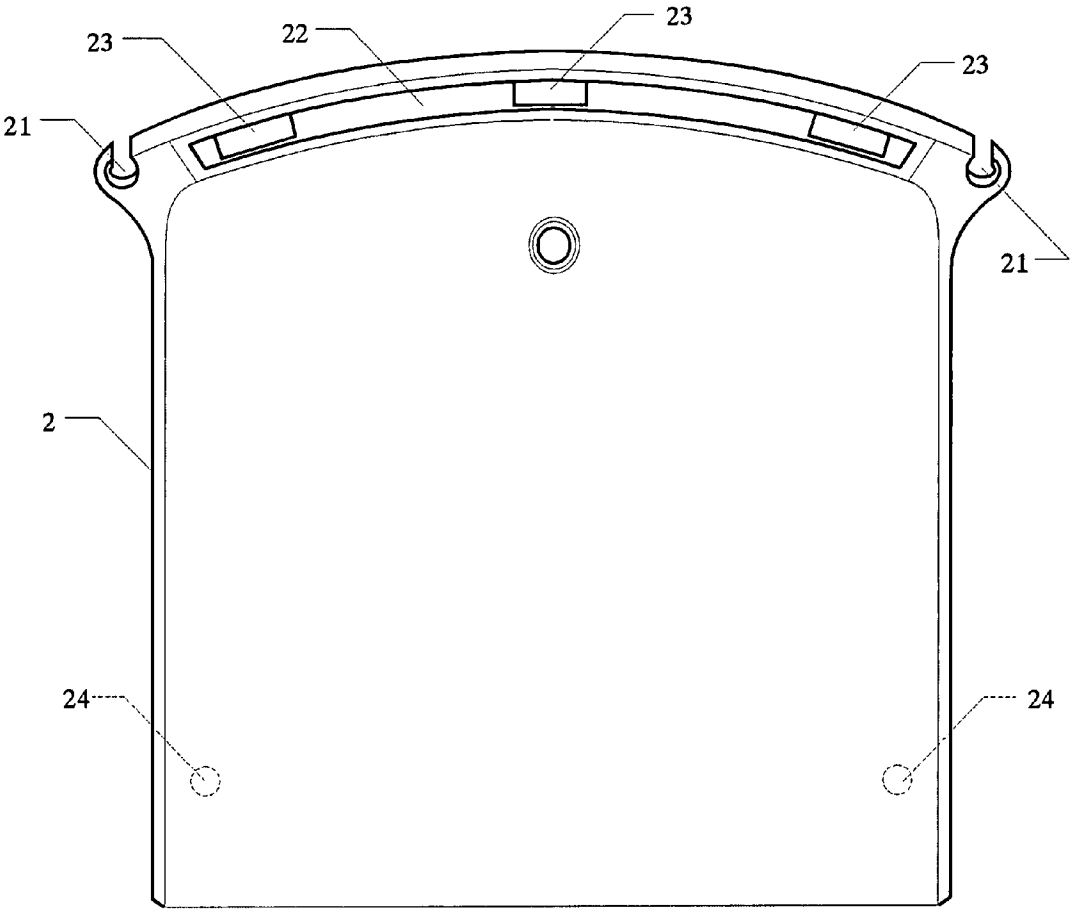
FIG. 3 shows the cushion of the present invention.
Figure 4:
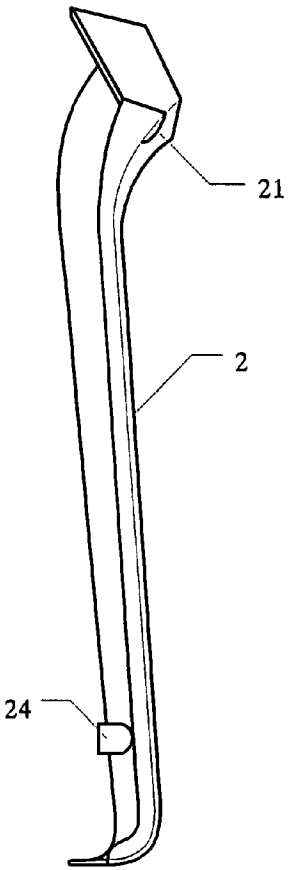
FIG. 4 shows the lateral view of FIG. 3.

Referring to FIGS. 3 and 4, a cushion 2 has two buckling openings 21 at a backside thereof for buckling the supporting rods 12 of the seat frame 11. The backside of the cushion 2 has at least one recess 22. At least one through hole 23 is formed in the recess 22. Two sides of a bottom of the cushion 2 are formed with positioning posts 24 corresponding to the penetrating holes 111 of the frame body 1.

Figure 5:
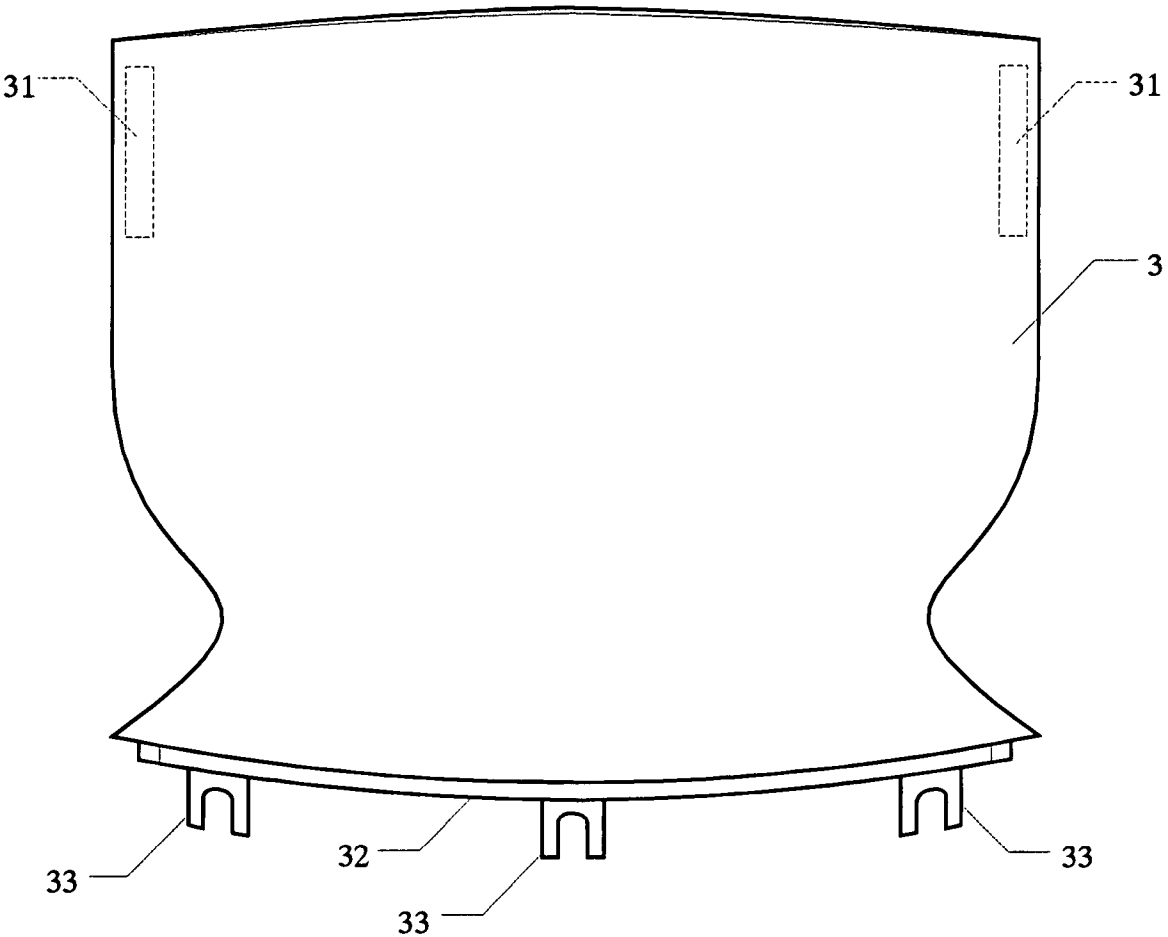
FIG. 5 shows the back pad of the present invention.
Figure 6:
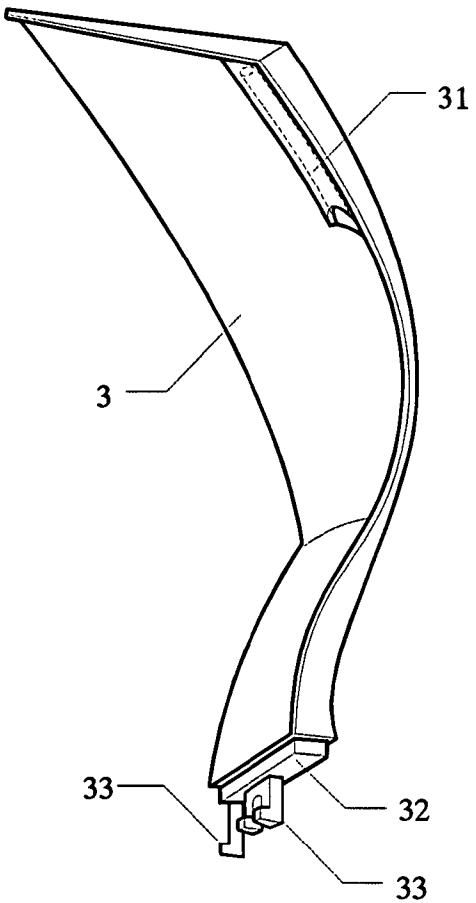
FIG. 6 shows the left side view of FIG. 5.
Figure 9:
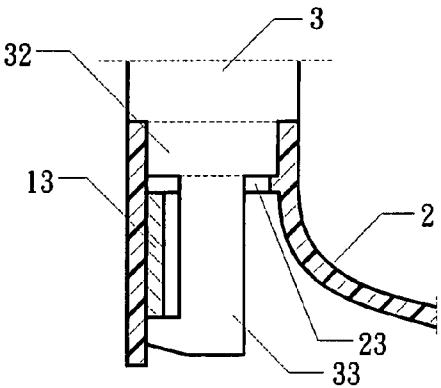
FIG. 9 is an assembled schematic view about the assembly of the supporting rod, cushion and back pad according to the present invention.
Figure 7:
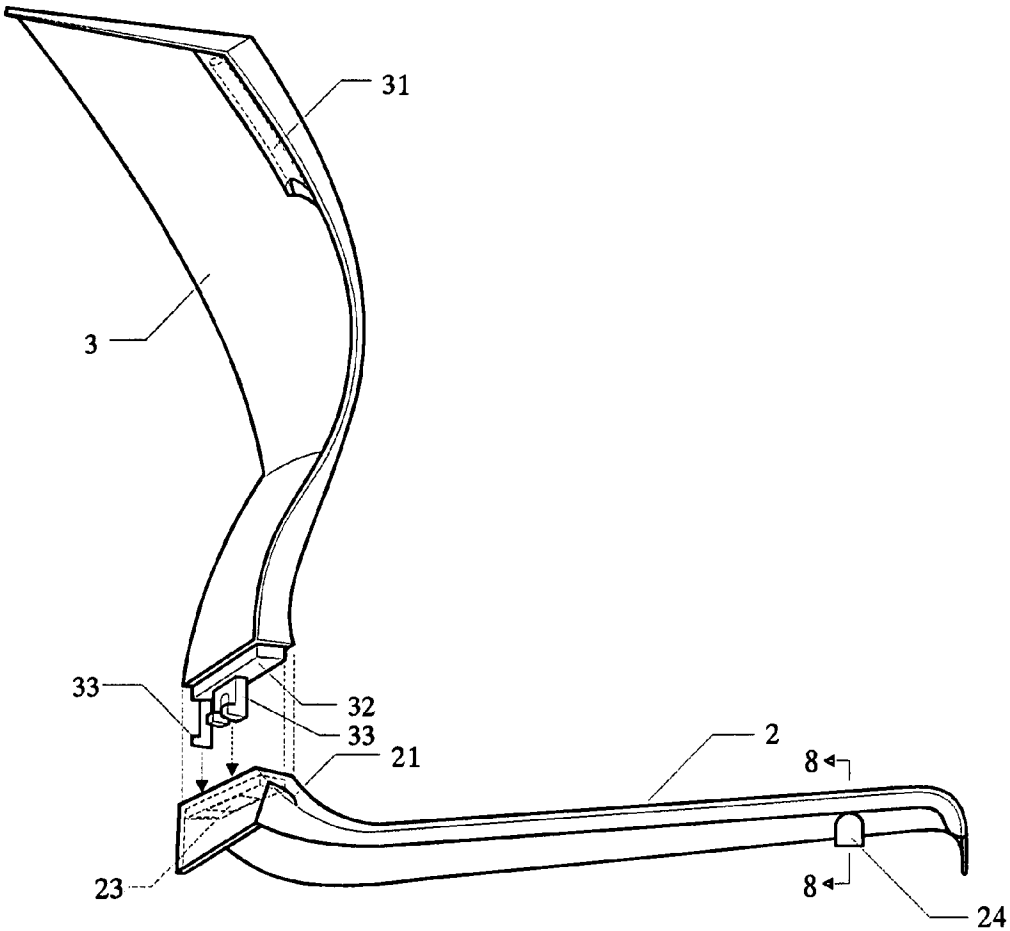
FIG. 7 is an assembled schematic view of the cushion and the back pad of the present invention.

Referring to FIGS. 5 and 7, a back surface of the back pad 3 is installed with two inserting tubes 31 corresponding to the supporting rods 12 of the frame body 1. A lower edge of the back pad 3 is formed with at least one protruding sheet 32. At least one hook 33 is installed at the protruding sheet 32. The protruding sheet 32 is engageble to the recess 22 of the cushion 2. The hook 33 of the protruding sheet 32 can pass through the through hole 23 of the recess 22 of the cushion 2 to hook the back rod 13 of the seat frame 11 (referring to FIG. 9).

Figure 8:
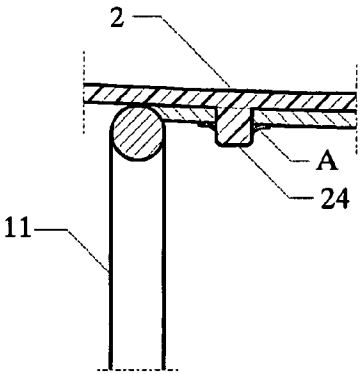
FIG. 8 is a cross sectional view along line 8-8 of the present invention.

Referring to FIG. 8, the positioning posts 24 at the front bottom of the cushion 2 passes through and protrudes out of the penetrating holes 111 of the seat frame 11 of the frame body 1. A retainer A serves to retain the cushion 2 to the seat frame 11 of the frame body 1.

Figure 10:
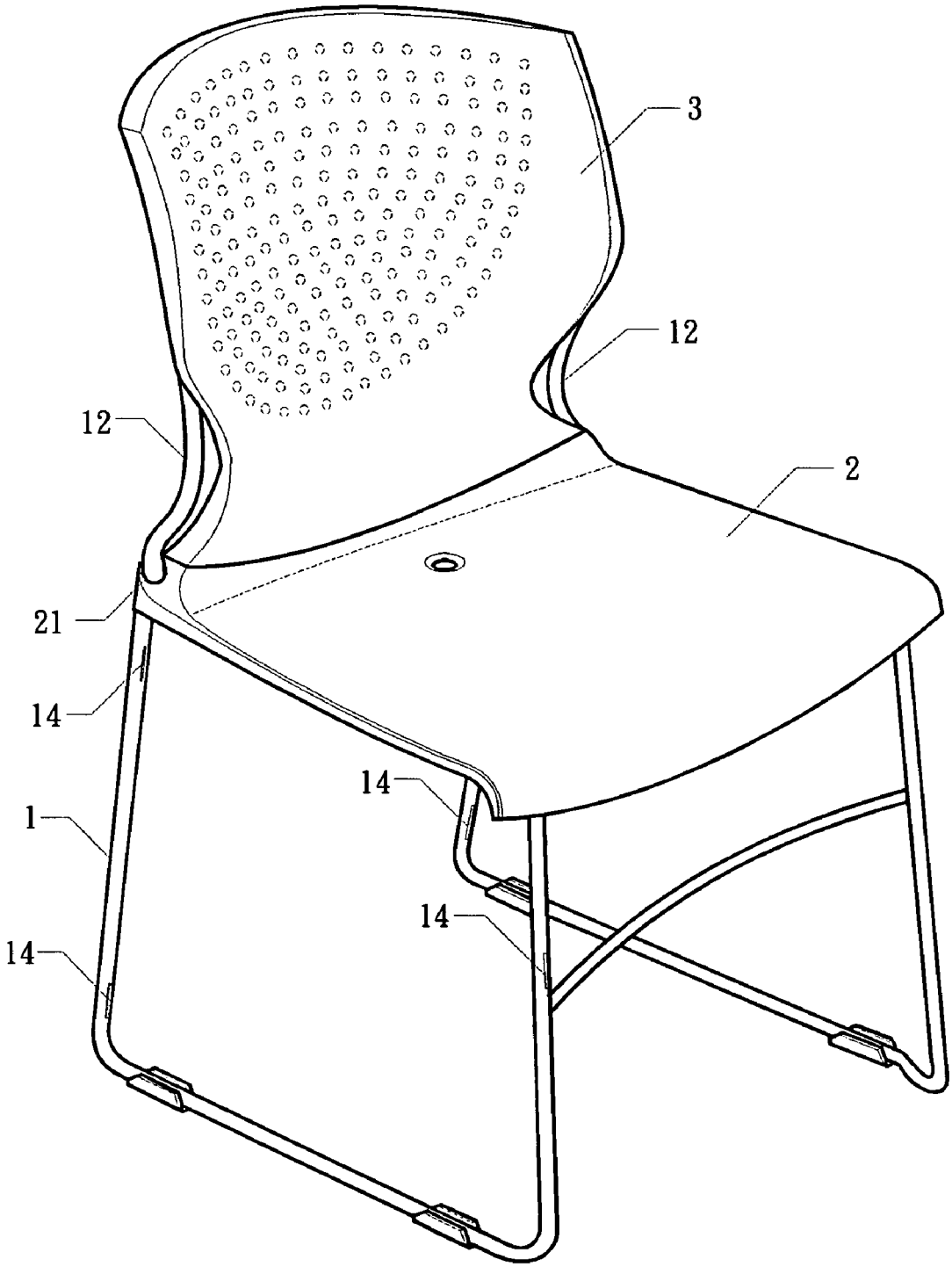
FIG. 10 shows the second embodiment of the present invention.
Figure 11:
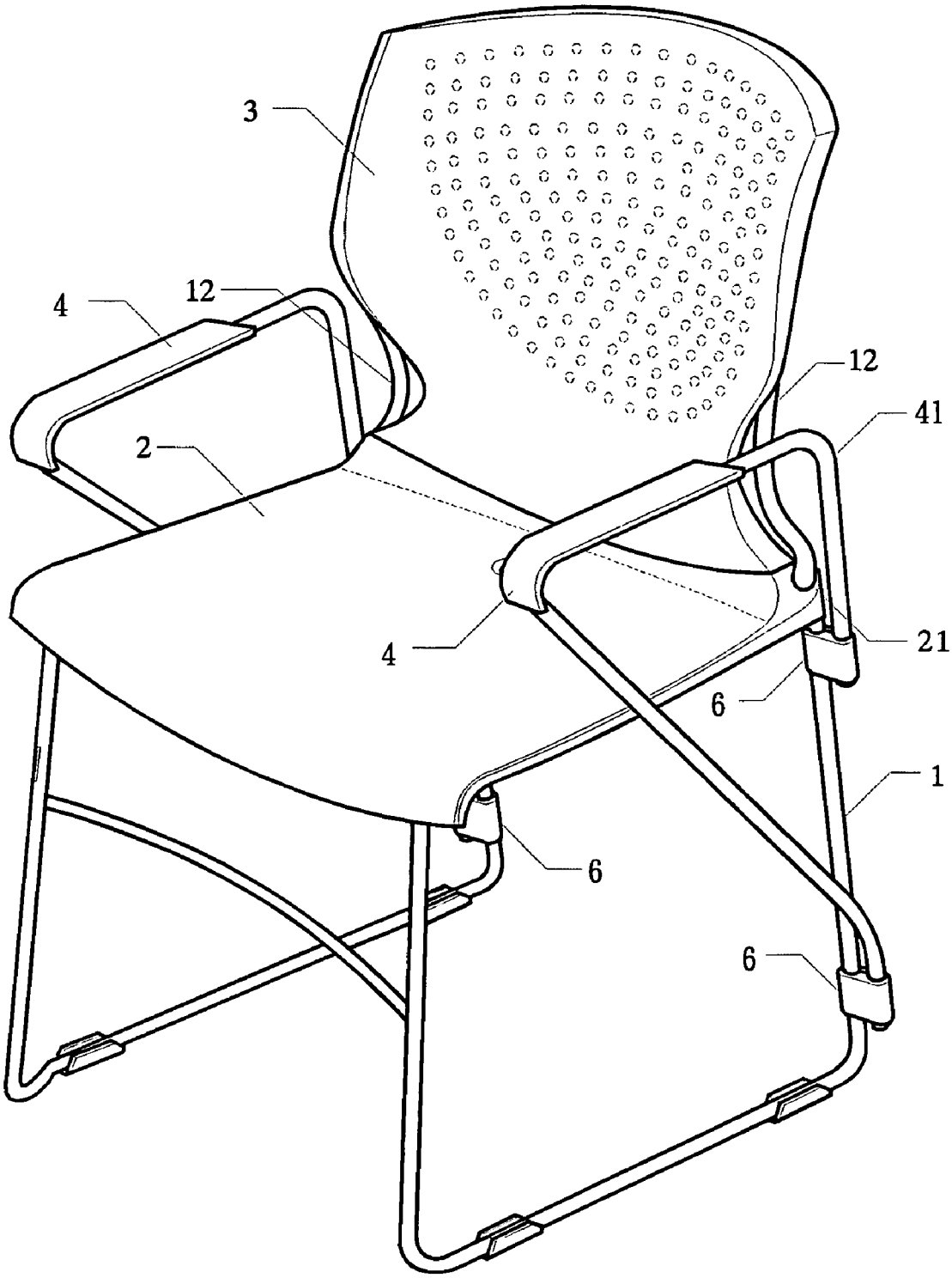
FIG. 11 shows the embodiment of the handles of the present invention.
Figure 12:
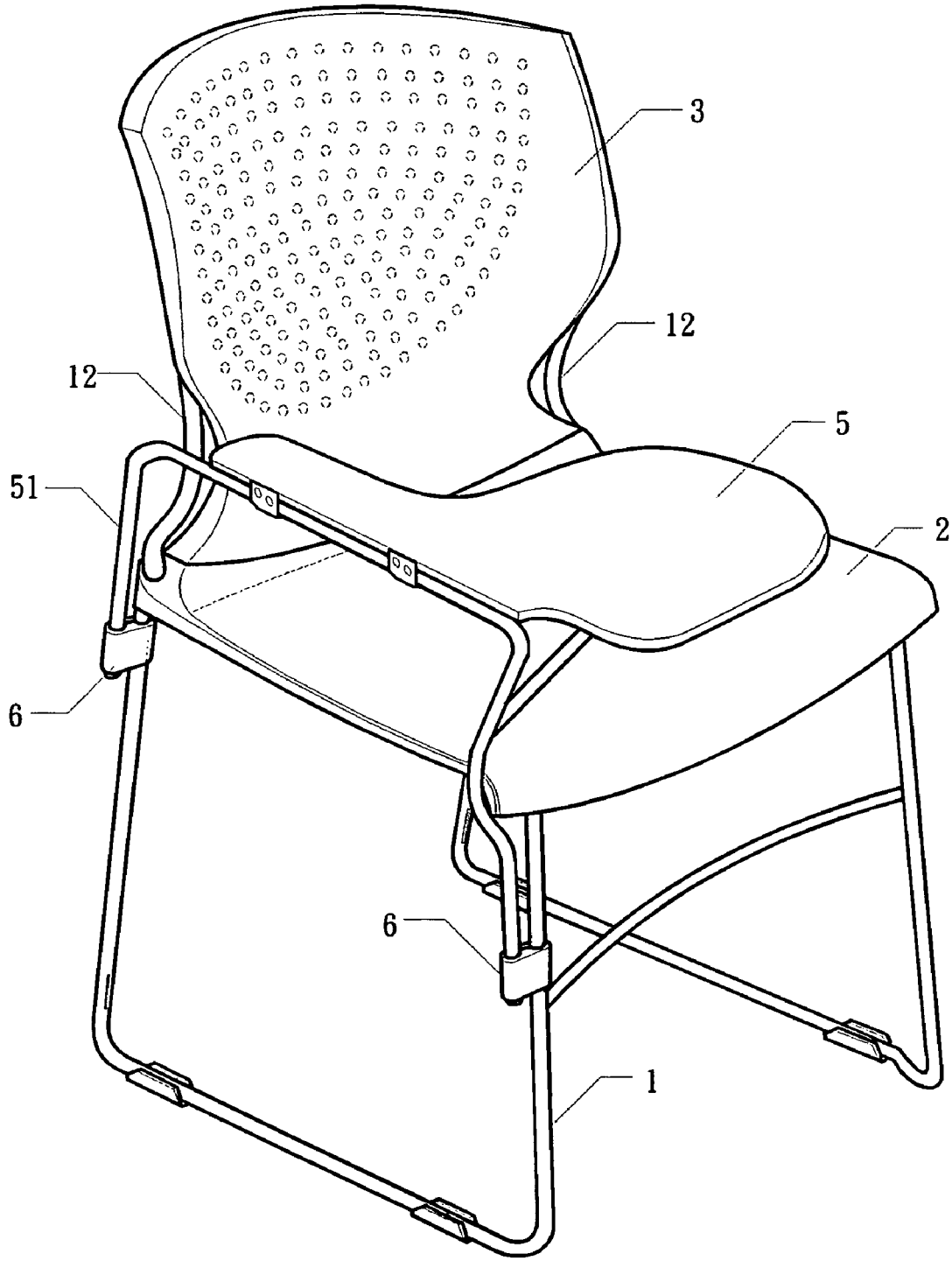
FIG. 12 shows the embodiment about the table plate of the present invention.
Figure 14:
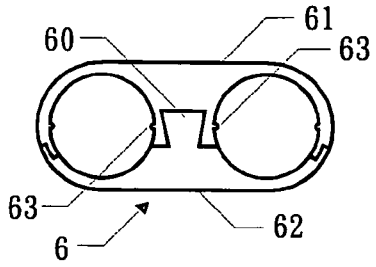
FIG. 14 is an elevation view of FIG. 13.
Figure 16:
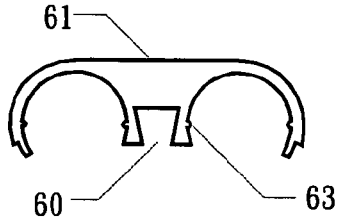
FIG. 16 is an elevational view of FIG. 15.
Figure 13:
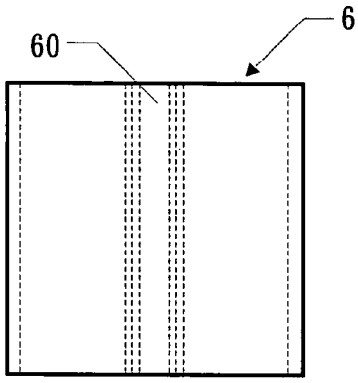
FIG. 13 shows the combining device of the present invention.
Figure 15:
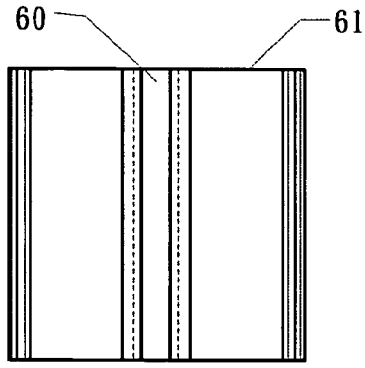
FIG. 15 shows the semi-round structure of the present invention.
Figure 18:
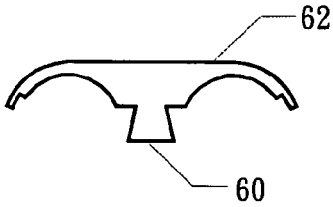
FIG. 18 is an elevational view of FIG. 17.
Figure 19:
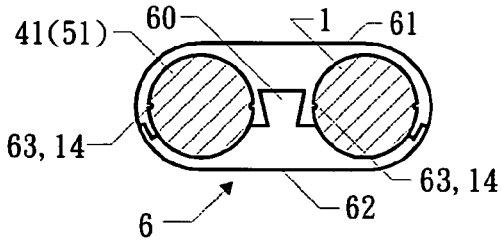
FIG. 19 shows a cross sectional view about the buckling of the combining device to the legs and handles or table plate according to the present invention.
Figure 17:
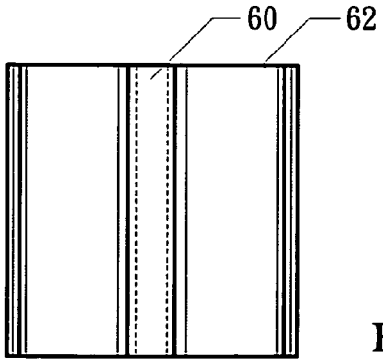
FIG. 17 shows another semi-round structure of the present invention.

Referring to FIGS. 10, 11 and 12, the second embodiment of the present invention is illustrated. The frame body 1 has two legs. Each leg is formed with a buckling trench 14. A combining device 6 is buckled to the buckling trench 14. Then handles 4 or table plate 5 can be installed to the combining device 6. FIGS. 13 to 19 show embodiments about the combining device 6. In FIG. 13, the combining device 6 is formed by two half casings 61, 62. Each half casing 61, 62 has two semi-rounds. The two half casings 61, 62 can be coupled to one another so that the two form two round hollow holes. See FIG. 11, one hole of the combining device 6 serves for receiving the leg of the seat frame 11 and another hole of the combining device 6 serves to receive a supporting frame 41 of a handle 4 or a supporting frame 51 of a table plate 5. An inner wall of one hole of the combining device 6 has a strip 63 corresponding to the buckling trench 14 of the leg of the seat frame 11 so that the strip 63 can be buckled to the trench 14.

Advantages of the present invention will be described herein. By the engagement of the at least one penetrating hole of the frame body and the at least hook of the back pad, the frame body, cushion and back pad are combined firmly. The assembly work can be performed rapidly, easily and conveniently. All the elements are assembled by insertion or buckling, and thus the assembly work is time-saved. All the elements can be reused easily. The present invention can be combined with a table plate or handles by combining devices.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An easy-assembled chair comprising:

a frame body having a seat frame;

a cushion; a backside of the cushion having at least one recess; at least one through hole being formed in the recess;

a back pad; a lower edge of the back pad being formed with at least one protruding sheet; at least one hook being installed at the protruding sheet;

wherein the hook installed at the protruding sheet passes through the through hole of the recess of the cushion to hook the seat frame; and wherein the cushion has at least one buckling opening at the backside thereof for buckling at least one supporting rod of the seat frame.

2. An easy-assembled chair comprising:

a frame body having a seat frame;

a cushion; a backside of the cushion having at least one recess; at least one through hole being formed in the recess;

a back pad; a lower edge of the back pad being formed with at least one protruding sheet; at least one hook being installed at the protruding sheet;

wherein the hook installed at the protruding sheet passes through the through hole of the recess of the cushion to hook the seat frame; and wherein the frame body has supporting rods; and a rear side of the seat frame has a back rod; the at least one hook of the back pad hooks the back rod so as to secure the back pad to the frame body.

3. An easy-assembled chair comprising:

a frame body having a seat frame; the seat frame having legs;

a cushion; a backside of the cushion having at least one recess; at least one through hole being formed in the recess;

a back pad; a lower edge of the back pad being formed with at least one protruding sheet; at least one hook being installed at the protruding sheet;

a combining device for combining handles or a table plate to the legs of the seat frame of the frame body; and wherein the hook of the protruding sheet passes through the through hole of the recess of the cushion to hook the seat frame.

4. The easy-assembled chair as claimed in claim 3, wherein a back surface of the back pad is installed with two inserting tubes corresponding to supporting rods of the frame body.

5. The easy-assembled chair as claimed in claim 3, wherein positioning posts at a front bottom of the cushion pass through and protrude out of penetrating holes of the seat frame of the frame body; a retainer serves to retain the cushion to the seat frame of the frame body.

6. The easy-assembled chair as claimed in claim 3, wherein legs of the seat frame are formed with trenches for combining the combining device.

7. The easy-assembled chair as claimed in claim 3, wherein the combining device is formed by two half casings; each half casing has two semi-rounds; the two half casings are coupled to one another so that the two form two round hollow holes.

8. The easy-assembled chair as claimed in claim 3, wherein an inner wall of one hole of the combining device has a strip corresponding to a buckling trench of a leg of the seat frame so that the strip can be buckled to the trench.

9. The easy-assembled chair as claimed in claim 3, wherein the frame body has supporting rods; and a rear side of the seat frame has a back rod; the at least one hook of the back pad hooks the back rod so as to secure the back pad to the frame body.

10. The easy-assembled chair as claimed in claim 3, wherein the frame body has supporting rods; and a front side of the seat frame has a plurality of penetrating holes for assembling the cushion.

11. The easy-assembled chair as claimed in claim 3, wherein the cushion has at least one buckling opening at the backside thereof for buckling at least one supporting rod of the seat frame.

12. The easy-assembled chair as claimed in claim 3, wherein a front side of the seat frame of the frame body has a plurality of penetrating holes; two sides of a bottom of the cushion are formed with positioning posts corresponding to the penetrating holes of the frame body.

* * * * *